US006893318B2

(12) United States Patent
Søviknes et al.

(10) Patent No.: US 6,893,318 B2
(45) Date of Patent: May 17, 2005

(54) FLEXIBLE FIGURE

(76) Inventors: Ørjan Søviknes, Nye Sandviksvei 69C, Bergen (NO), N-5035; Geir Sætveit, Lyshovden 226, Fyllingsdalen (NO), N-5148

( * ) Notice: Subject to any disclaimer, the term of this patent is extended or adjusted under 35 U.S.C. 154(b) by 0 days.

(21) Appl. No.: 10/481,183

(22) PCT Filed: Jul. 3, 2002

(86) PCT No.: PCT/NO02/00245

§ 371 (c)(1),
(2), (4) Date: Dec. 18, 2003

(87) PCT Pub. No.: WO03/004121

PCT Pub. Date: Jan. 16, 2003

(65) Prior Publication Data

US 2004/0171328 A1 Sep. 2, 2004

Related U.S. Application Data

(60) Provisional application No. 60/303,067, filed on Jul. 6, 2001.

(51) Int. Cl.[7] ..... A63H 3/46

(52) U.S. Cl. ..... 446/379; 446/376; 446/375; 446/390

(58) Field of Search ..... 446/376, 379, 446/275, 279, 381–383, 390, 375, 278, 286, 486, 317, 380

(56) References Cited

U.S. PATENT DOCUMENTS

| | | | | |
|---|---|---|---|---|
| 1,293,056 A | * | 2/1919 | Dun Lany | 446/379 |
| 1,321,028 A | * | 11/1919 | Giebeler-Wanke | 446/380 |
| 1,348,216 A | * | 8/1920 | Giebeler-Wanke | 446/380 |
| 2,567,453 A | * | 9/1951 | Swenson et al. | 446/286 |
| 2,788,611 A | * | 4/1957 | Weih | 446/379 |
| 2,791,063 A | | 5/1957 | Gardel | |
| 3,010,253 A | * | 11/1961 | Ostrander | 446/380 |
| 3,540,150 A | * | 11/1970 | Hollingsworth et al. | 446/381 |
| 3,589,061 A | | 6/1971 | Bear | |
| 3,940,880 A | * | 3/1976 | Kaelin et al. | 446/381 |
| 3,955,312 A | | 5/1976 | Pugh | |
| 3,988,855 A | * | 11/1976 | Crabtree et al. | 446/380 |
| 4,197,358 A | | 4/1980 | Garcia | |
| 4,526,553 A | | 7/1985 | Guerro | |
| 5,017,173 A | | 5/1991 | Shapero | |
| 5,630,745 A | | 5/1997 | Yeh | |
| 6,074,270 A | | 6/2000 | Wilcox | |
| 6,074,271 A | | 6/2000 | Derrah | |
| 6,110,002 A | | 8/2000 | Langton | |
| 6,267,640 B1 | | 7/2001 | Akashi | |
| 6,431,940 B1 | * | 8/2002 | Buford et al. | 446/277 |
| 6,478,653 B1 | * | 11/2002 | Langton | 446/373 |

FOREIGN PATENT DOCUMENTS

| | | |
|---|---|---|
| DE | 41 38736 C1 | 11/1991 |
| EP | 0 323832 | 1/1989 |
| EP | 1005886 A1 | 6/2000 |
| WO | WO 01/08779 | 2/2001 |

* cited by examiner

*Primary Examiner*—Bena B. Miller
(74) *Attorney, Agent, or Firm*—Onsagers AS; Christian D. Abel

(57) ABSTRACT

A flexible figure in the form of a human engaged in a particular athletic or recreational activity, such as snowboarding. The figure further comprises arm and leg sections connected at realistic joints, and joined to the torso by couplings all of which realistically simulate the flexibility limitations of the human body. A length of elastic material functioning as an artificial muscle, which is connected between the upper leg and the lower leg behind the knee joints, and an resilient covering over the elbow joints, automatically return the figure to a preselected starting stance.

7 Claims, 9 Drawing Sheets

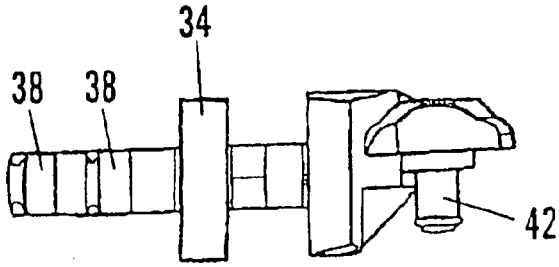
Fig.8
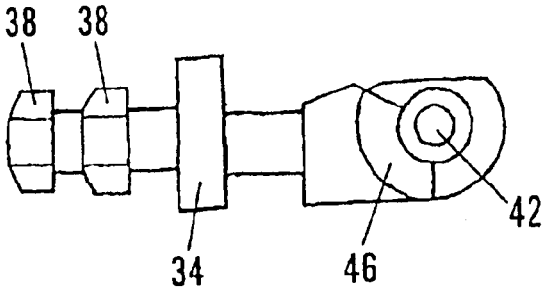
Fig.9
Fig.10
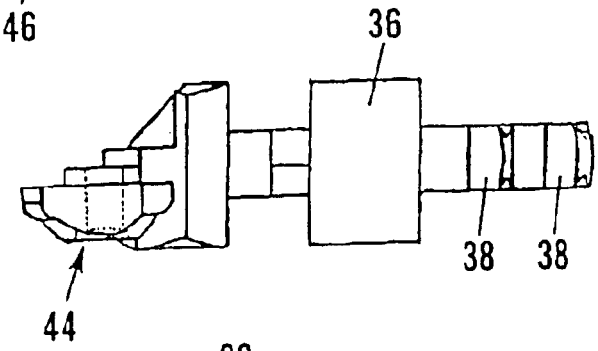
Fig.11
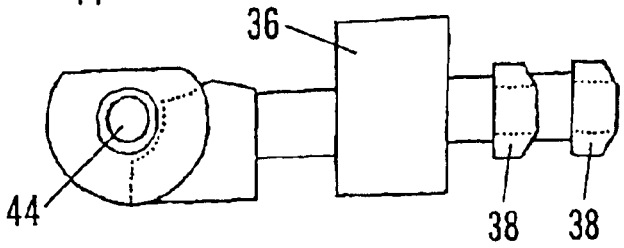
Fig.12
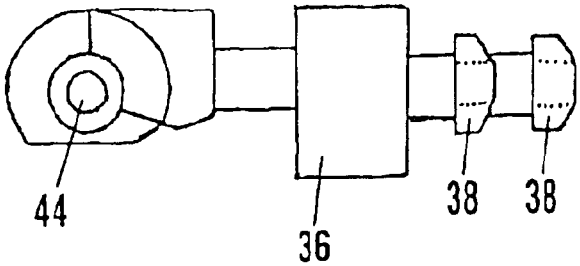

FLEXIBLE FIGURE

This application claims the benefit of provisional application No. 60/303,067, filed Jul. 6, 2001.

FIELD OF THE INVENTION

The present invention relates to flexible figures, and in particular to a figure having a novel limb, joint and torso construction permitting the accurate simulation of athletic movements.

BACKGROUND OF THE INVENTION

Many sports and recreational activities, such as snowboarding, skateboarding, skiing and the like, involve the performance of complex stunts and maneuvers. Poseable figures are often used as a visual aid in order to practice or demonstrate these stunts. The figure disclosed in U.S. Pat. No. 6,110,002 to Langton (1997) is an example of one such visual aid. Another example specifically directed towards snowboarding and skiing is the figure marketed by N.S.M. Resource Corp, Tahoe City Calif. under the name of HUCK DOLL™. (www.huckdoll.com). These and other known figures, while capable of mimicking body movement to a certain degree, have an internal skeleton designed to maintain the figure in a rigid, posed position. Accordingly, existing figures are not capable of accurately simulating the fluid, dynamic body movements associated with athletic maneuvers.

A need exists, therefore, for a flexible figure that can simulate the smooth, dynamic movements of an athlete or recreational sports enthusiast. A need also exists for a flexible figure that takes into account the effects of muscle tension and the flexibility parameters of the torso, limbs and joints in order to accurately demonstrate stunts or assess the feasibility of new maneuvers.

SUMMARY OF THE INVENTION

The present invention comprises a flexible figure in the form of a human engaged in a particular athletic or recreational activity, such as snowboarding according to one aspect of the invention. The doll is outfitted with realistic equipment associated with the particular activity, such as a board, bindings, boots and gloves in the case of snowboarding. The figure has a torso section constructed of a resilient material designed to approximate, in scale, the weight, dimensions and flexibility of the human torso, shoulders and hips. The figure has upper and lower leg segments, constructed of rigid plastic, connected at a knee joint that approximates the flexibility limitations of the human knee. Upper and lower leg members are connected to the torso section and boots, respectively, by a coupling designed to prevent unnatural twisting motions. The figure further comprises upper and lower arm sections connected at a realistic elbow joint, and joined to the torso by a coupling similar that of the leg segments.

A length of elastic material functioning as an artificial muscle is connected between the upper leg and the lower leg behind the knee joints. The length and tension of this elastic material is predetermined in order to maintain the figure in a preselected stance. For example, in the case of snowboarding, the elastic material maintains the figure in the balanced, knees-bent cruising position. The elbow joints are likewise covered by a resilient material such as silicone, of a predetermined shape designed to maintain the arms in a preselected starting position. For example, in the case of snowboarding, the arms are maintained in an extended, slightly bent position. Because the leg and arm positions of the figure so closely approximate the proper cruising position of a snowboard rider, the figure is extremely well balanced and is in fact self-standing. The elastic material behind the knee joints, and the resilient covering of the elbow joints, provide a realistic representation of the flexibility of the limbs when the figure is manipulated, and causes the figure to automatically return to the balanced starting position.

The various components of the figure can be removed and replaced as needed. This allows damaged parts to be easily replaced. This also enables the figure to be customized by employing parts having various configurations, such as the torso and artificial muscle, in order to represent various "styles" of snowboarding, skiing and the like. In this way the figure can be assembled having the characteristic "style" of well-known athletes.

In the case of the snowboarding embodiment, the figure further comprises gloves made of resilient material configured to permit accurate simulation of the grasping of the board, which is common in many snowboarding maneuvers.

DESCRIPTION OF THE DRAWINGS

FIGS. 8 and 9 are elevational views of an upper leg member.

FIGS. 10, 11 and 12 are elevational views of a lower leg member.

DETAILED DESCRIPTION OF THE PREFERRED EMBODIMENT

Figure 1:
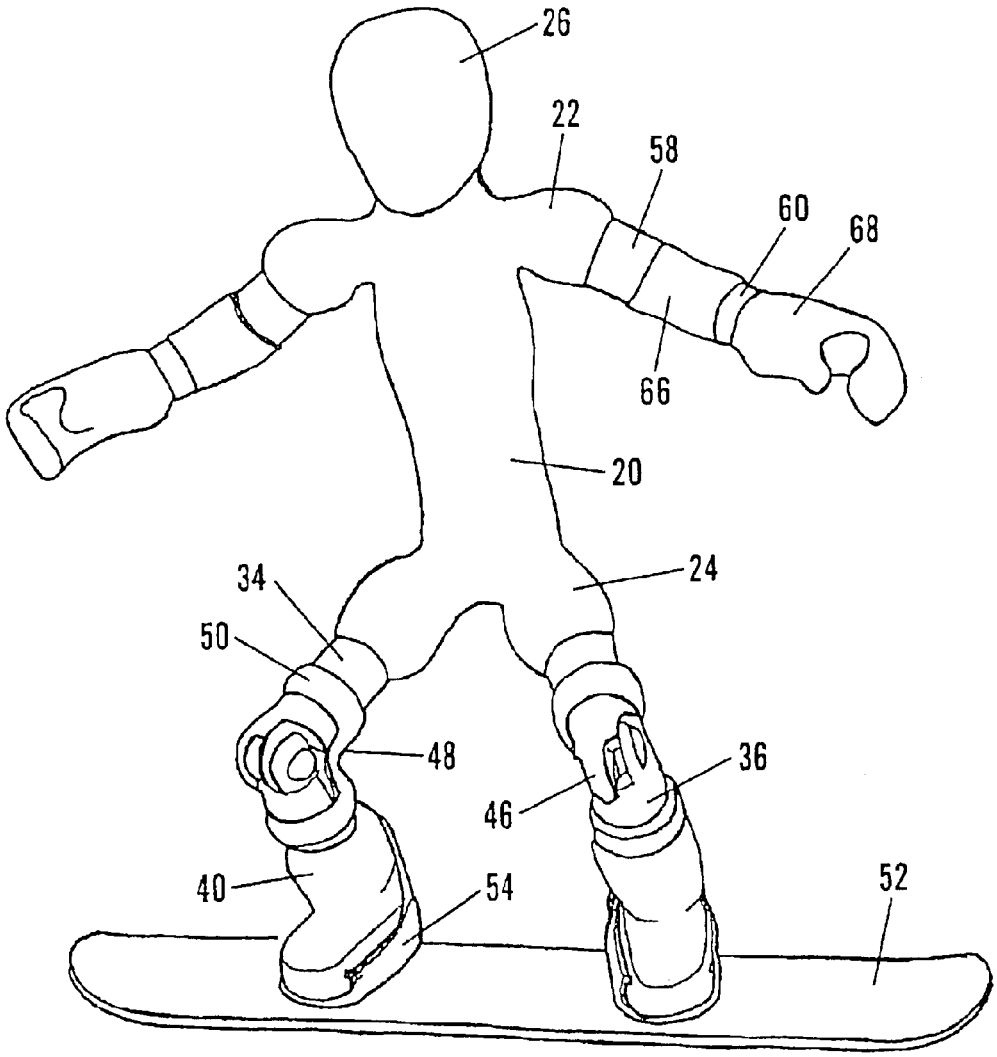
FIG. 1 is a perspective view of the flexible figure according to the invention.
Figure 2:
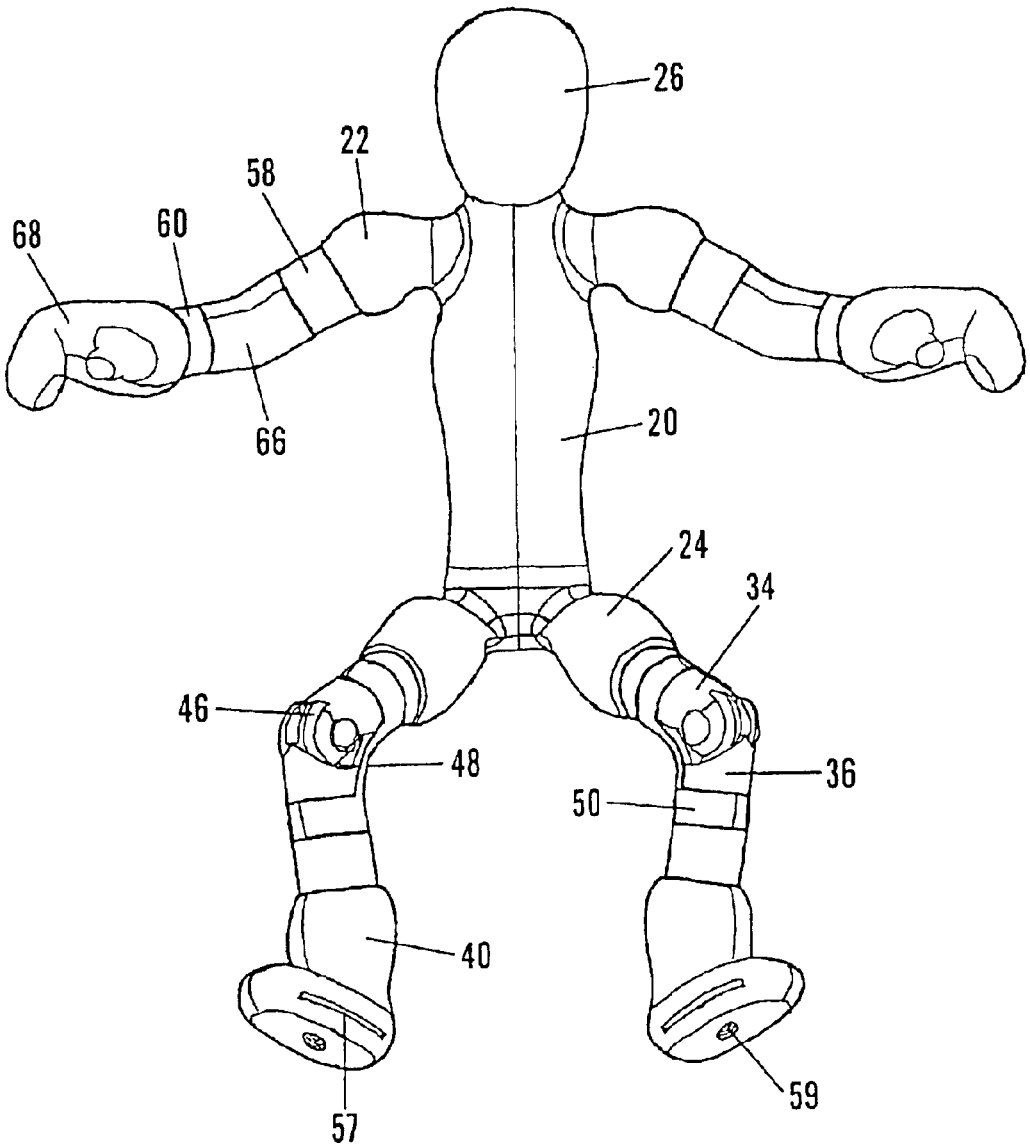
FIG. 2 is a front view of the flexible figure according to the invention.
Figure 3:
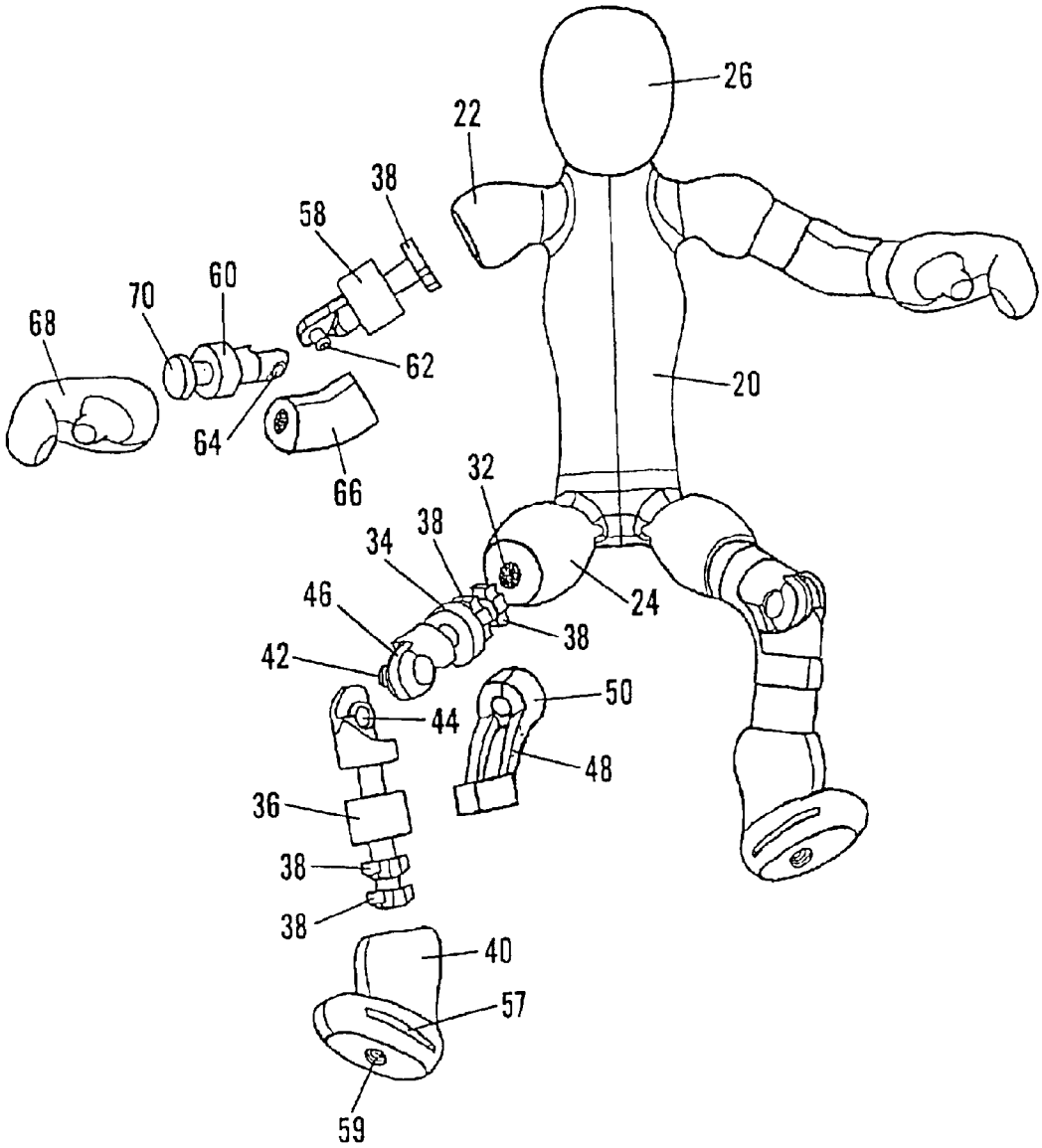
FIG. 3 is an exploded view of the flexible figure according to the invention.
Figure 4:
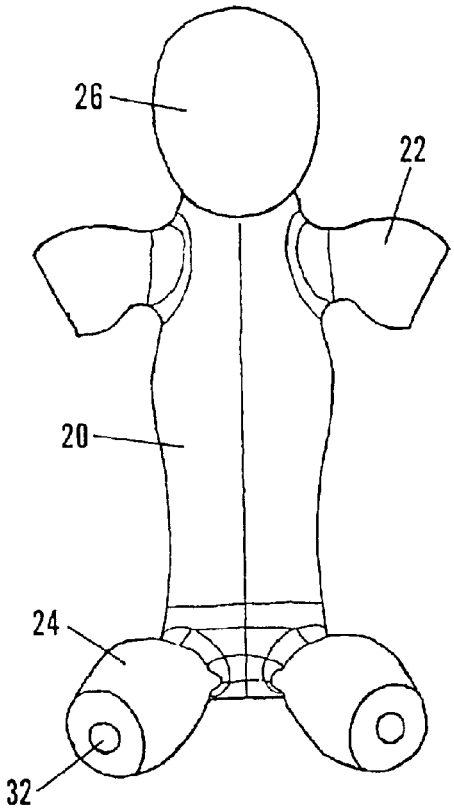
FIG. 4 is a front view of the torso segment.
Figure 5:
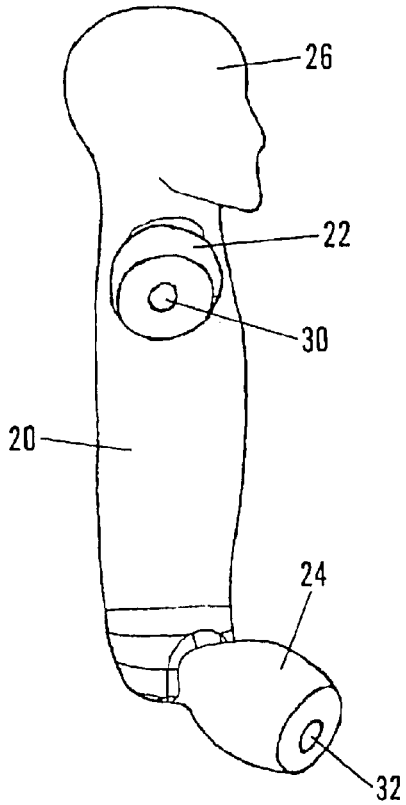
FIG. 5 is a side view of the torso segment.

As shown in FIG. 1, the present invention is a flexible figure in the form of a human engaged in a particular activity, such as snowboarding in the preferred embodiment. The flexible figure according to the present invention, as shown in FIGS. 1, 2 and 3, comprises a torso 20 made of a resilient, rubberized material. Torso 20 includes two integrated shoulder sections 22 and two integrated upper-thigh sections 24. As shown in FIG. 4 and FIG. 5, shoulder sections 22 and upper-thigh sections 24 are reduced in diameter at the point of attachment to torso 20. This reduced-diameter area increases the flexibility of shoulder sections 22 and upper thigh sections 24. Each of shoulder sections 22 and upper thigh sections 24 further include a generally annular opening 30 and 32, respectively. Openings 30 and 32 lead to internal cavities having a specific shape, as described below.

The flexible figure further includes an integrated head segment 26. In the preferred embodiment, head 26 can be molded in the likeness of well-known snowboarding professionals.

Figure 6:
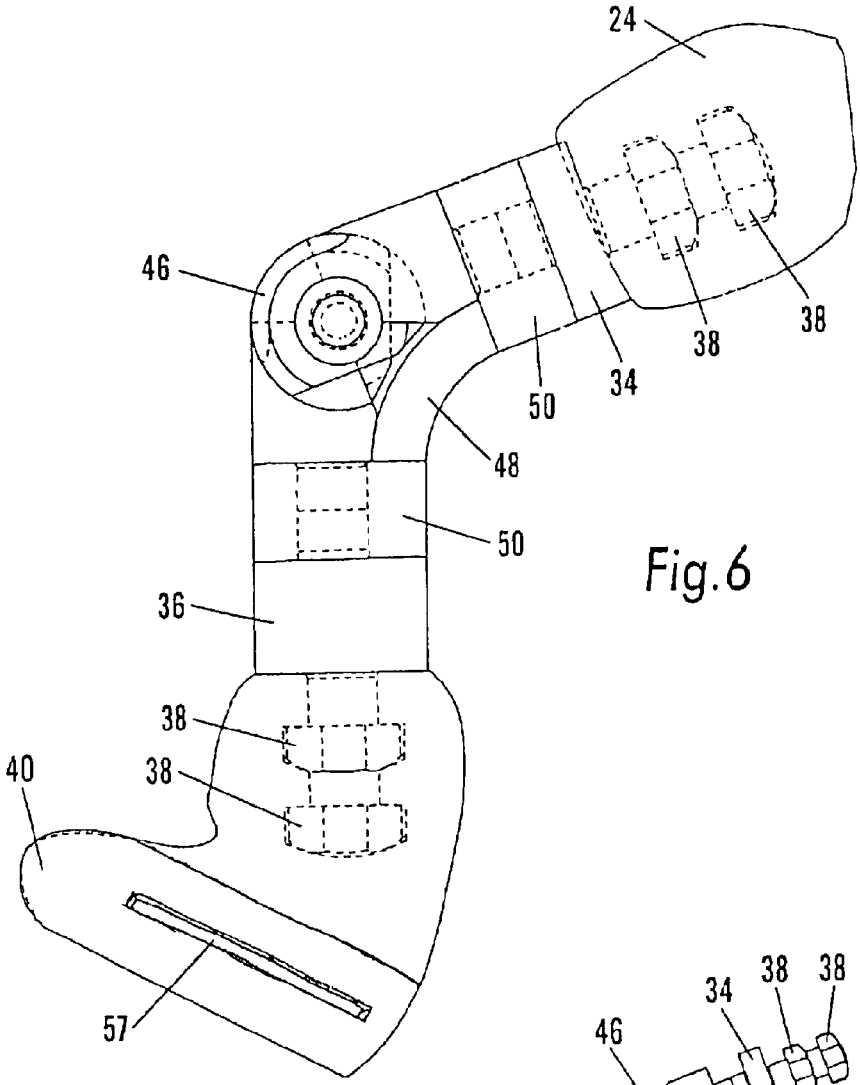
FIG. 6 is a sectional view of a leg segment.
Figure 7:
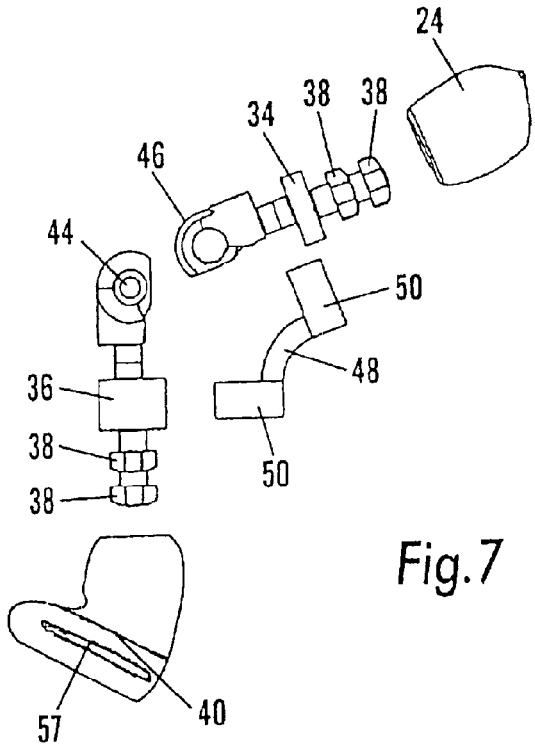
FIG. 7 is an exploded view of a leg segment.

As shown in FIGS. 3, 6 and 7, each of the two leg segments of the figure according to the invention comprises an upper leg member 34 and a lower leg member 36. Upper leg member 34 is attached to upper thigh section 24 with the help of an extension having two projections 38 that are inserted into opening 32, such that the projections engage the above-described internal cavity. The internal cavity in upper thigh section 24 has approximately the same shape and dimensions as projections 38, and engages projections 38 in a friction fit. Projections 38 and the internal cavity thus cooperate to provide a firm connection while at the same time preventing unnatural rotation of the leg segments. Because upper thigh sections 24 are made of resilient material, a limited, natural degree of rotation is nonetheless permitted. Lower leg members 36 also include extensions having two projections 38, which engage openings in two resilient boots 40. In the preferred embodiment, boots 40 are formed in the likeness of snowboarding boots.

Upper leg member 34 and lower leg member 36 are connected at a knee joint that approximates the flexibility limitations of the human knee. As shown in FIGS. 8 and 9, upper leg member 34 includes a pin 42. Pin 42 pivotally engages a corresponding socket 44 on lower leg member 36 in a snap fit. As shown in FIGS. 1, 3, and 7, upper leg member 34 and lower leg member 36 each include a semicircular ridge 46. Semicircular ridge 46 is configured such that its leading edge contacts an abutment on the opposite leg member when the leg segment is fully extended, in order to prevent hyperextension of the knee joint.

The leg segments of the figure according to the invention further comprise an elongated elastic member 48 as shown in FIGS. 3, 6 and 7. Elastic member 48 functions as an artificial muscle, which provides resistance when the figure is manipulated, and causes the legs of the figure to automatically return to their original position. In the preferred embodiment, elastic member 48 is split into two halves as shown in FIG. 3. The split allows the two halves of elastic member 48 to bulge away from one another when the figure is bent into an extreme crouching position, thus allowing a greater range of motion.

At each end of elastic member 48 is a circular, split collar 50. Each of said collars 50 is attached to a reduced-diameter portion of upper leg member 34 and lower leg member 36, slightly above and below the knee joint respectively, such that elastic member 48 is on the dorsal side of the knee joint. Elastic member 48 is of a predetermined length and elasticity, selected to maintain the leg segments of the flexible figure bent at a specific angle.

Figure 16:
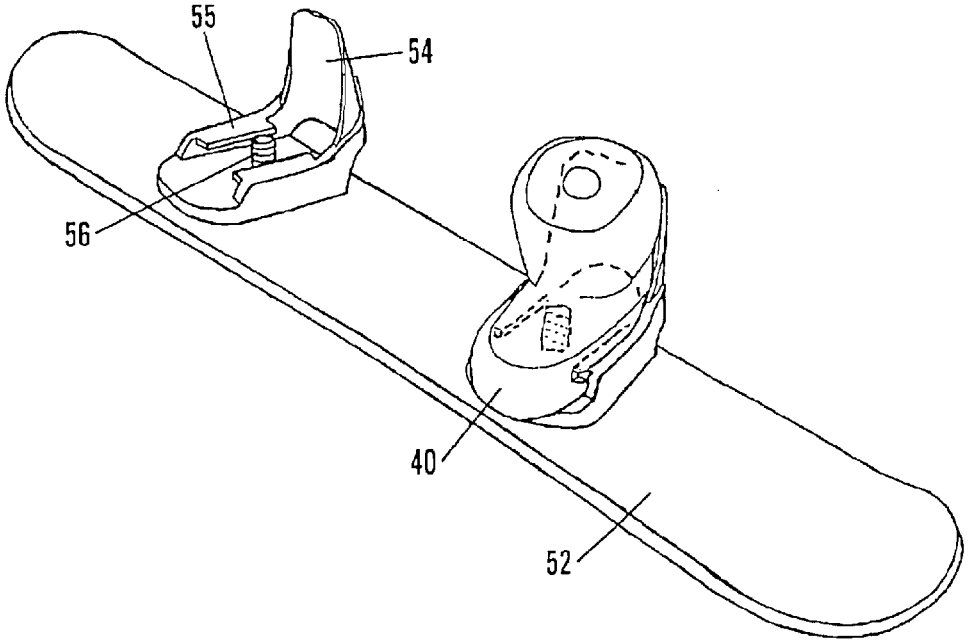
FIG. 16 is a detailed view of the snowboard and bindings.
Figure 17:
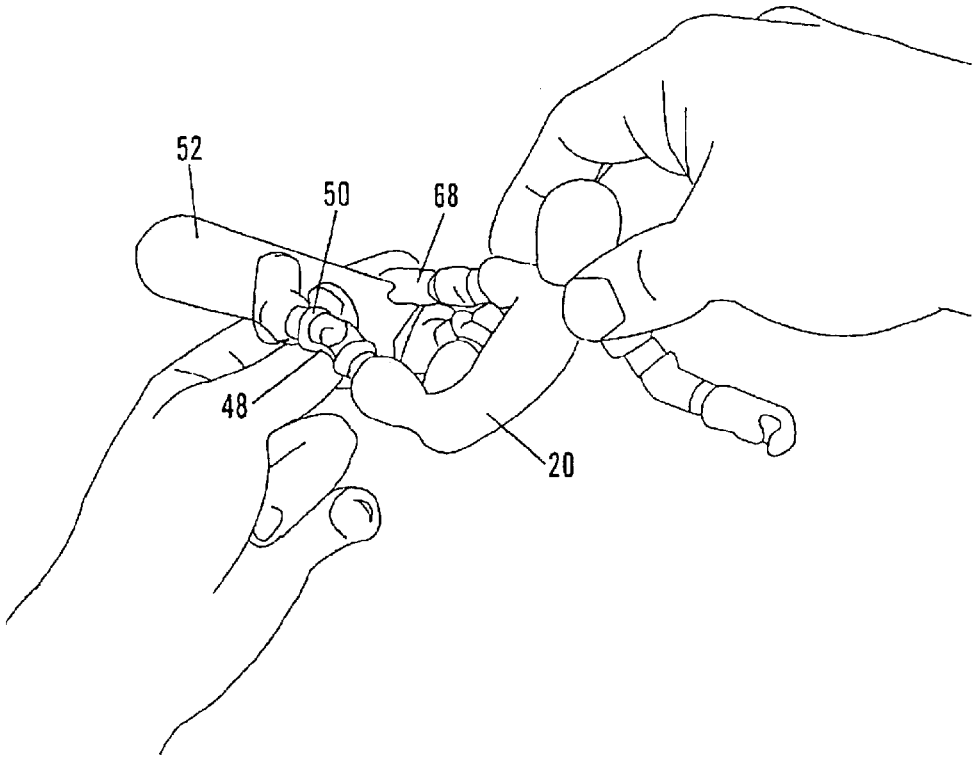
FIG. 17 is a perspective view of the flexible figure in use.

The preferred embodiment of the invention is a figure engaged in snowboarding. The invention therefore further comprises a snowboard 52 having two bindings 54, as shown in FIGS. 1 and 16. Bindings 54 have two inwardly projecting ridges 55 which slidably engage two corresponding grooves 57 in boots 40. In the preferred embodiment, boots 40 are made of two types of material, a lower section made of a relatively hard plastic into which grooves 57 are embedded, and a more flexible, upper section. After boots 40 are slid into bindings 54, two screws 56 are inserted through snowboard 52 and bindings 56, and engage two threaded holes 59 in the soles of boots 40.

Figure 13:
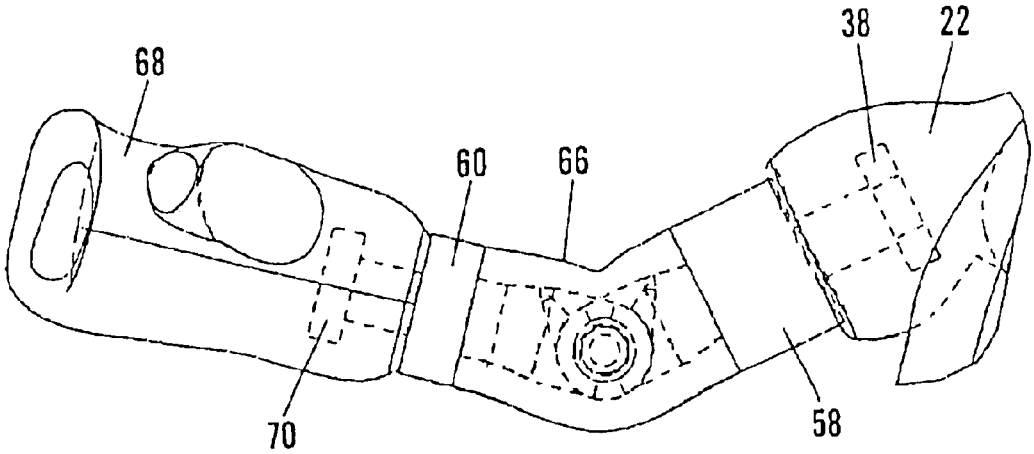
FIG. 13 is a sectional view of an arm segment.
Figure 14:
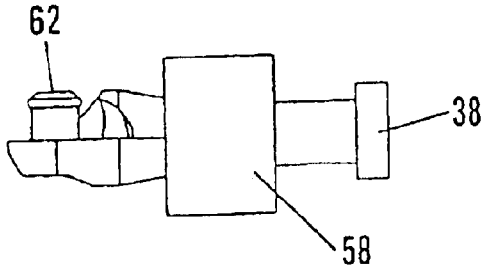
FIG. 14 is an elevational view of an upper arm member.
Figure 15:
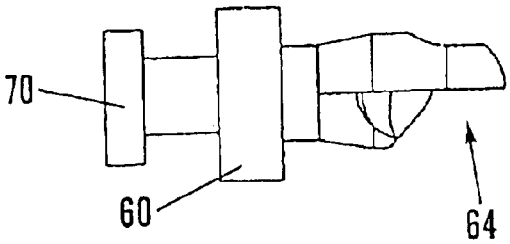
FIG. 15 is an elevational view of a lower arm member.

The figure according to the invention further comprises two arm segments. Each arm segment comprises an upper arm member 58 and a lower arm member 60 joined together at an elbow joint, as shown in FIG. 3 and FIG. 13. As shown in FIGS. 14 and 15, upper arm member 58 includes a pin 62 that pivotally engages a corresponding socket 64 on lower arm member 60 in a snap fit. Upper arm member 58 includes a projection 38 that is inserted in shoulder opening 30 in shoulder section 22. Shoulder section 22 has an internal cavity of approximately the same shape and dimensions as projection 38. The cavity engages projection 38 in a friction fit that prohibits unnatural rotation of upper arm member 58.

Each arm segment also includes an elbow covering 66 made of resilient material such as silicone rubber. Elbow covering 66 is split along its length, permitting it to be wrapped around the elbow joint. As shown in FIG. 13, elbow covering 66 is formed with a bend of a predetermined angle. As further shown in FIG. 3 and FIG. 13, a glove 68 made of resilient material is attached to lower arm member 60 with the help of a circular projection 70 located at the end of lower arm member 60.

Referring to FIGS. 1, 4, and 5, it can be seen that the orientation and configuration of shoulder sections 22, upper thigh sections 24, elastic members 48 and elbow coverings 66 are selected in order to maintain the figure in a specific, predetermined stance. In the preferred embodiment the predetermined stance is the one commonly known as the "cruising position". In this stance, the figure is slightly crouching, with knees bent and arms extended. In the preferred embodiment, the figure's center of gravity is oriented above snowboard 52 such that the figure is self-standing.

FIG. 14 illustrates the flexible figure according to the invention being used to demonstrate a common snowboarding maneuver. Because of the elastic and resilient properties of its various components, the figure automatically returns to the stance depicted in FIG. 1 after use.

What is claimed is:

1. A flexible figure in the form of a human body having a ventral and a dorsal side, comprising a torso made of resilient material having a head section and integrated shoulder and upper thigh sections, whereby the shoulder and upper thigh sections are flexible in relation to the torso;

openings at the ends of the shoulder and upper thigh sections that lead into internal cavities, said internal cavities having internal walls;

upper arm and upper leg sections made of rigid material, having extensions that are inserted into the cavities in the shoulder sections and upper thigh sections respectively and are held firmly in place by a friction fit;

lower arm and lower leg sections made of rigid material that are rotatably connected at their upper ends to the upper arm and upper leg sections by snap-fit elbow and knee joints respectively, said joints having rotation-limitation means that prevent hyperextension of said joints;

a resilient covering that may be removably placed over said elbow joint, said resilient covering having a bend of a predetermined angle chosen to hold the upper and lower arm sections bent at a preselected starting position, the resiliency of said covering being chosen so as to provide a predetermined amount of resistance to rotation of the elbow joint and to return the upper and lower arm sections to their starting position when no external force is being applied;

an elastic member attached between the upper and lower leg sections, said elastic member having a length chosen so as to hold the upper and lower leg sections bent at a preselected starting position, the elasticity being chosen so as to provide a predetermined amount of resistance to rotation of the knee joint and to return the upper and lower leg sections to their starting position when no external force is being applied;

an extension of the lower end of each lower arm section that engages an opening in a hand section made of resilient material;

an extension of the lower end of each lower leg section that engages an opening in a boot member.

2. Flexible figure according to claim 1, whereby said extensions of said of said upper arm and upper leg sections have a plurality of projections that engage the internal walls of said internal cavities.

3. Flexible figure according to claim 2, whereby the elastic member attached between the upper and lower leg members comprises two elastic annular parts each having a split permitting the annular parts to be removably attached to the upper and lower leg sections, and one or more elastic bands connected between the annular parts on the dorsal side of the figure.

4. Flexible figure according to claim 3, whereby the resilient covering of the elbow joint, and the annular parts for the elastic member each attach to their respective appendage at points of the appendage having reduced diameter, such that the respective appendage has a relatively uniform surface appearance along its length when the resilient covering and elastic member are in place.

5. Flexible figure according to claim 4, whereby the boot member comprises a resilient upper section and a rigid lower section, said rigid lower section having grooves that slideably engage corresponding ridges in a miniature binding member attached to a miniature snowboard.

6. Flexible figure according to claim 5, whereby the boot member has a threaded opening in its sole, the miniature snowboard has a corresponding hole, and a screw is used to attach the miniature snowboard to the boot member.

7. Flexible figure according to claim 6, whereby the hand section is in the form of a glove having a thumb.

* * * * *